US007086711B2

(12) United States Patent
Iwao et al.

(10) Patent No.: US 7,086,711 B2
(45) Date of Patent: Aug. 8, 2006

(54) INKJET PRINTING APPARATUS AND ACTUATOR CONTROLLER AND ACTUATOR CONTROLLING METHOD USED IN INKJET PRINTING APPARATUS

(75) Inventors: Naoto Iwao, Nagoya (JP); Ayumu Matsumoto, Nagoya (JP)

(73) Assignees: Brother Kogyo Kabushiki Kaisha, Nagoya (JP); Kyocera Corporation, Kyoto (JP)

( * ) Notice: Subject to any disclaimer, the term of this patent is extended or adjusted under 35 U.S.C. 154(b) by 112 days.

(21) Appl. No.: 10/667,496

(22) Filed: Sep. 23, 2003

(65) Prior Publication Data

US 2004/0095404 A1 May 20, 2004

(30) Foreign Application Priority Data

Sep. 24, 2002 (JP) ..... 2002-277926

(51) Int. Cl.
*B41J 29/38* (2006.01)

(52) U.S. Cl. ..... 347/10

(58) Field of Classification Search ..... 347/9, 347/10, 11, 14, 68
See application file for complete search history.

(56) References Cited

U.S. PATENT DOCUMENTS

| | | | | |
|---|---|---|---|---|
| 4,369,455 A | | 1/1983 | McConica et al. | |
| 4,897,665 A | | 1/1990 | Aoki | |
| 5,736,994 A | * | 4/1998 | Takahashi | 347/11 |
| 6,099,103 A | * | 8/2000 | Takahashi | 347/11 |
| 6,257,685 B1 | | 7/2001 | Ishikawa | |
| 6,350,003 B1 | * | 2/2002 | Ishikawa | 347/11 |
| 6,527,354 B1 | | 3/2003 | Takahashi | |
| 2001/0043242 A1 | | 11/2001 | Takahashi | |

FOREIGN PATENT DOCUMENTS

| | | |
|---|---|---|
| JP | A 11-20165 | 1/1999 |
| JP | A 11-170516 | 6/1999 |
| JP | A 2001-310461 | 11/2001 |
| JP | A 2001-315330 | 11/2001 |
| JP | A 2001-322272 | 11/2001 |

* cited by examiner

*Primary Examiner*—K. Feggins
*Assistant Examiner*—Rene Garcia, Jr.
(74) *Attorney, Agent, or Firm*—Oliff & Berridge, PLC.

(57) ABSTRACT

An actuator unit is driven with a voltage pulse supplied from a driver IC. The actuator unit can take two states of a first state wherein the volume of a pressure chamber is V1, and a second state wherein the volume of the pressure chamber is V2 larger than V1. A state of the actuator unit changes from the first state to the second state and then to the first state again so that ink is ejected through a nozzle connected to one end of the pressure chamber. A pulse width Tw of the voltage pulse to be supplied to the actuator unit is shorter than a pulse width Tmax at which a maximum ejection speed of ink ejected from the nozzle is obtained. Thus, with simplifying a waveform of the voltage pulse, two of large and small ink droplets can be successively ejected in the order of the large and small ink droplets.

15 Claims, 12 Drawing Sheets

FIG. 9

| RELATIONS AMONG PULSE WIDTH,EJECTION SPEED, AND SIZE RATIO [AL=5.4 μS] | | |
|---|---|---|
| PULSE WIDTH | EJECTION SPEED | SIZE RATIO |
| 4. 0 | 4. 76 | 1. 50 |
| 4. 5 | 6. 06 | 0. 75 |
| 5. 0 | 7. 69 | 0. 67 |
| 5. 5 | 7. 69 | 0. 60 |
| 6. 0 | 6. 06 | 0. 67 |
| 6. 5 | 5. 13 | 1. 17 |

| RELATIONS AMONG PULSE WIDTH,EJECTION SPEED, AND SIZE RATIO [AL=5.2 μS] | | |
|---|---|---|
| PULSE WIDTH | EJECTION SPEED | SIZE RATIO |
| 3. 4 | 6. 25 | 1. 50 |
| 4. 0 | 7. 69 | 1. 00 |
| 4. 4 | 8. 70 | 0. 86 |
| 5. 0 | 11. 11 | 0. 75 |
| 5. 4 | 11. 11 | 0. 75 |
| 6. 0 | 7. 41 | 0. 86 |
| 6. 4 | 6. 06 | 0. 86 |

| RELATIONS AMONG PULSE WIDTH,EJECTION SPEED, AND SIZE RATIO [AL=5.0 μS] | | |
|---|---|---|
| PULSE WIDTH | EJECTION SPEED | SIZE RATIO |
| 3. 0 | 6. 45 | |
| 3. 5 | 7. 69 | 1. 50 |
| 4. 0 | 8. 70 | 3. 00 |
| 4. 5 | 11. 11 | 0. 86 |
| 5. 0 | 11. 76 | 0. 75 |
| 5. 5 | 11. 76 | 0. 75 |
| 6. 0 | 10. 53 | 0. 60 |
| 6. 5 | 6. 25 | 0. 88 |
| 7. 0 | 4. 17 | 1. 17 |

INKJET PRINTING APPARATUS AND ACTUATOR CONTROLLER AND ACTUATOR CONTROLLING METHOD USED IN INKJET PRINTING APPARATUS

BACKGROUND OF THE INVENTION

1. Field of the Invention

The present invention relates to an inkjet printing apparatus for ejecting ink onto a record medium to print, and also to an actuator controller and an actuator controlling method used in the inkjet printing apparatus.

2. Description of Related Art

A printing head in an inkjet printer includes therein an ink tank and pressure chambers. Each pressure chamber is supplied with ink from the ink tank. When an actuator is driven to change the volume of a pressure chamber, ink in the pressure chamber is pressurized to be ejected through a nozzle connected to the pressure chamber. Printing in a serial-type inkjet printer is performed with reciprocating such an inkjet printing head along the width of a print paper.

U.S. Pat. No. 6,527,354 discloses a technique for making a head in an inkjet printer eject two of large and small ink droplets through each nozzle successively in the order of the large and small ink droplets. In this technique, two different pulses, i.e., an ejection pulse and an additional pulse for pulling back part of an ink droplet, which is going to get away from the nozzle, into the ink passage, are applied in this order to the actuator unit. In case of a system for the so-called "fill before fire", as the ejection pulse, a pulse is adopted having its pulse width substantially equal to half the acoustic resonance period of each pressure chamber.

In the above system, however, because two different pulses of the ejection and additional pulses are supplied to the actuator to eject two of large and small ink droplets successively in that order, the pulse waveform is relatively complicated. The more complicated the pulse waveform is, the more longer the occupation time of a series of the pulse train required for ejecting a sries of ink droplets. That makes difficult to achieve a high-speed printing. Moreover, at a certain printing speed, the following problem may arise. That is, the room is reduced for adding another pulses that improve the print quality by, e.g., canceling a pressure wave remaining within the ink passage after the first ink ejection operation when two ink ejection operations are successively performed.

SUMMARY OF THE INVENTION

An object of the present invention is to provide an inkjet printing apparatus using a relatively simple pulse waveform to be supplied to an actuator for ejecting two of large and small ink droplets through each nozzle successively in the order of the large and small ink droplets, and also to provide an actuator controller and an actuator controlling method used in the inkjet printing apparatus.

According to an aspect of the present invention, an inkjet printing apparatus comprises a plurality of pressure chambers each having one end connected to a nozzle; an actuator that can take two states of a first state wherein the volume of a pressure chamber is V1, and a second state wherein the volume of the pressure chamber is V2 larger than V1; and an actuator controller for supplying a voltage pulse to the actuator to change a state of the actuator from the first state to the second state and then to the first state again so that ink is ejected through the nozzle, a pulse width Tw of the voltage pulse being shorter than a pulse width Tmax at which a maximum ejection speed of ink ejected from the nozzle is obtained.

According to another aspect of the present invention, an actuator controller is provided for controlling the drive of an actuator included in an inkjet printing apparatus, the inkjet printing apparatus comprising a plurality of pressure chambers each having one end connected to a nozzle. The actuator can take two states of a first state wherein the volume of a pressure chamber is V1, and a second state wherein the volume of the pressure chamber is V2 larger than V1. The actuator controller supplies a voltage pulse to the actuator to change a state of the actuator from the first state to the second state and then to the first state again so that ink is ejected through the nozzle. A pulse width Tw of the voltage pulse is shorter than a pulse width Tmax at which a maximum ejection speed of ink ejected from the nozzle is obtained.

According to still another aspect of the present invention, a method is provided of controlling the drive of an actuator included in an inkjet printing apparatus, the inkjet printing apparatus comprising pressure chambers each having one end connected to a nozzle. The actuator can take two states of a first state wherein the volume of a pressure chamber is V1, and a second state wherein the volume of the pressure chamber is V2 larger than V1. A state of the actuator changes from the first state to the second state and then to the first state again so that ink is ejected through the nozzle. The voltage pulse is supplied to the actuator, the voltage pulse having a pulse width Tw shorter than a pulse width Tmax at which a maximum ejection speed of ink ejected from the nozzle is obtained.

According to the invention, without applying two pulses having a complicated waveform to the actuator, two of large and small ink droplets can be successively ejected through a nozzle in the order of the large and small ink droplets. Therefore, with relatively simplifying the waveform of a pulse for driving the actuator, the room can be increased for improving the print quality by, e.g., canceling the pressure wave remaining within the ink passage.

BRIEF DESCRIPTION OF THE DRAWINGS

Other and further objects, features and advantages of the invention will appear more fully from the following description taken in connection with the accompanying drawings in which:

FIG. 9 are tables showing results of measurements of ejection speeds and size ratios of ink droplets when the pulse width Tw of the voltage pulse of FIG. 7A is variously changed;

DESCRIPTION OF THE PREFERRED EMBODIMENTS

Figure 1:
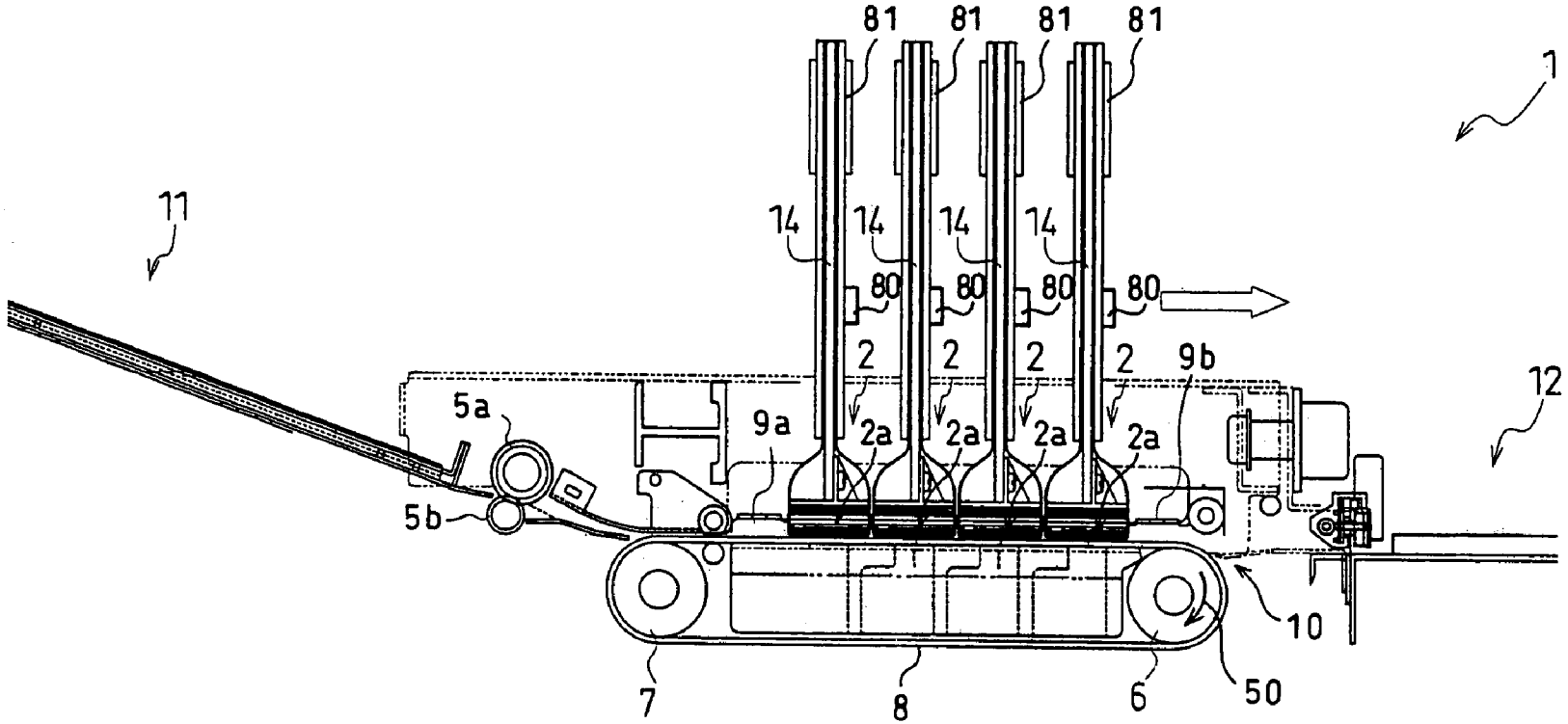
FIG. 1 illustrates a general construction of an inkjet printer (inkjet printing apparatus) according to an embodiment of the present invention.

FIG. 1 illustrates a general construction of an inkjet printer (inkjet printing apparatus) according to an embodiment of the present invention. The inkjet printer 1 of this embodiment is a color inkjet printer having four inkjet heads 2. Within the inkjet printer 1, a paper feed unit 11 and a paper discharge unit 12 are provided in left and right portions of FIG. 1, respectively. In the ink-jet printer 1, formed is a paper conveyance path for conveying a paper from the paper feed unit 11 to the paper discharge unit 12.

A pair of paper feed rollers 5*a* and 5*b* are disposed immediately downstream of the paper feed unit 11 for putting forward a paper as a print medium from the left to the right in FIG. 1. In the middle of the paper conveyance path, two belt rollers 6 and 7 and a looped conveyor belt 8 are provided. The conveyor belt 8 is wrapped around the belt rollers 6 and 7 to be stretched between them.

The conveyor belt 8 has a two-layered structure made up of a polyester base body impregnated with urethane and a silicone rubber. The silicone rubber is disposed in the outer portion of the conveyor belt 8 to form a conveyor face. A paper fed through the pair of paper feed rollers 5*a* and 5*b* is kept on the conveyor face of the conveyor belt 8 by chucking force. In this state, the paper is conveyed downstream, i.e., rightward in FIG. 1, by driving one belt roller 6 to rotate clockwise in FIG. 1 as indicated by an arrow 50.

Pressing members 9*a* and 9*b* are provided at positions for feeding a paper onto the conveyor belt 8 and discharging the paper from the conveyor belt 8, respectively. Either of the pressing members 9*a* and 9*b* is for pressing the paper onto the conveyor face of the conveyor belt 8 so as to prevent the paper from separating from the conveyor face.

A peeling device 10 is provided in the paper conveyance path immediately downstream of the conveyor belt 8, i.e., on the right in FIG. 1. The peeling device 10 peels off the paper, which is kept on the conveyor face of the conveyor belt 8 by chucking force, from the conveyor face so that the paper can be conveyed toward the rightward paper discharge unit 12.

Figure 2:
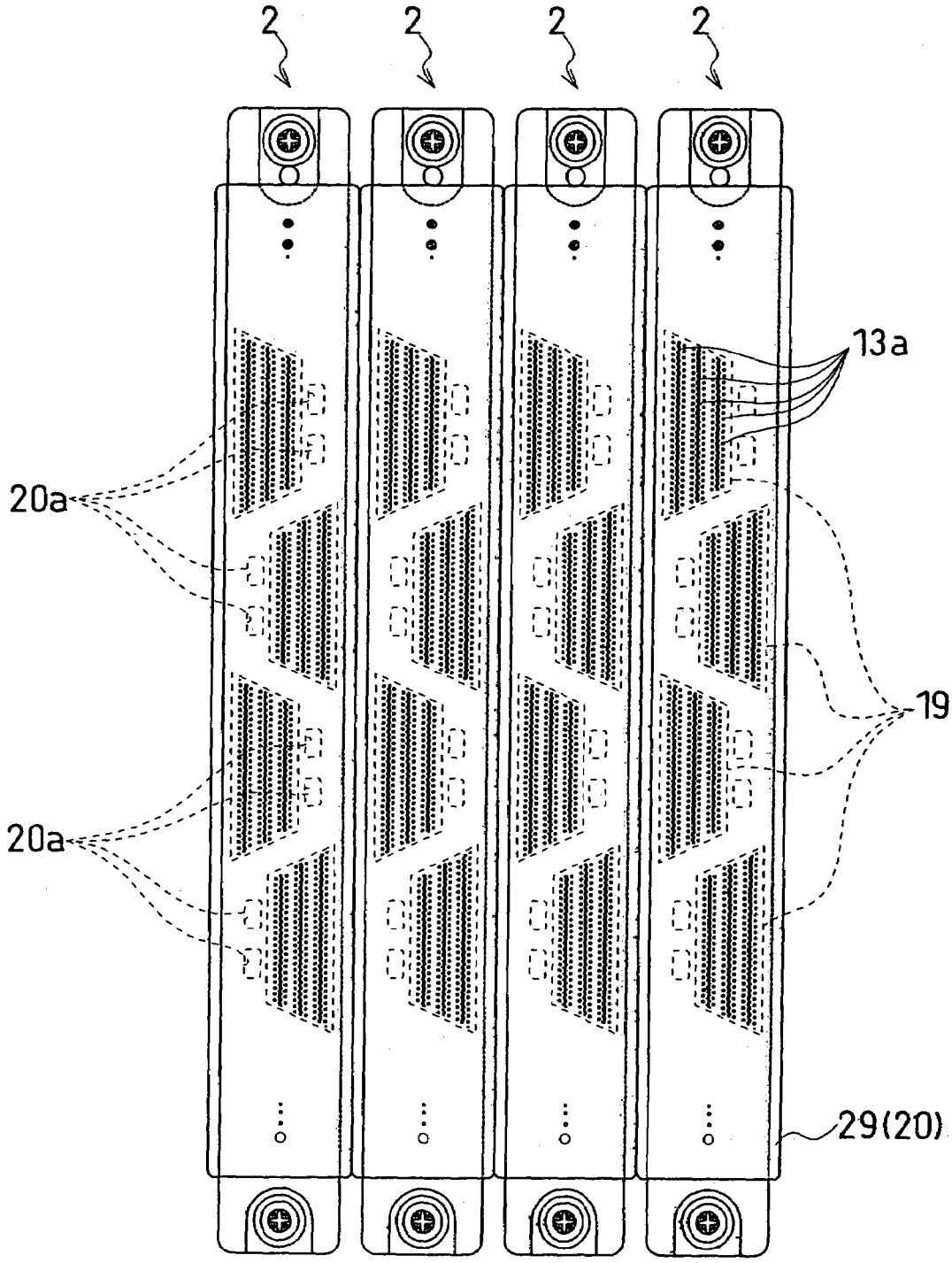
FIG. 2 is a bottom view of parallel inkjet heads in FIG. 1.

Each of the four inkjet heads 2 has, at its lower end, a head main body 2*a*. Each head main body 2*a* has a rectangular section. The head main bodies 2*a* are arranged close to each other with the length of each head main body 2*a* being perpendicular to the paper conveyance direction, i.e., perpendicular to FIG. 1. That is, this printer 1 is a line type printer. The bottom of each of the four head main bodies 2*a* faces the paper conveyance path. In the bottom of each head main body 2*a*, a large number of nozzles 13 (see FIG. 4) are provided each having a small-diameter ink ejection port 13*a* (see FIG. 2). The four head main bodies 2*a* eject ink of magenta, yellow, cyan, and black, respectively.

The head main bodies 2*a* are disposed such that a narrow clearance is formed between the lower face of each head main body 2*a* and the conveyor face of the conveyor belt 8. The paper conveyance path is formed within the clearance. In this construction, while a paper, which is being conveyed by the conveyor belt 8, passes immediately below the four head main bodies 2*a* in order, the respective color inks are ejected through the corresponding nozzles 13 (see FIG. 4) toward the upper face, i.e., the print face, of the paper to form a desired color image on the paper.

Figure 3:
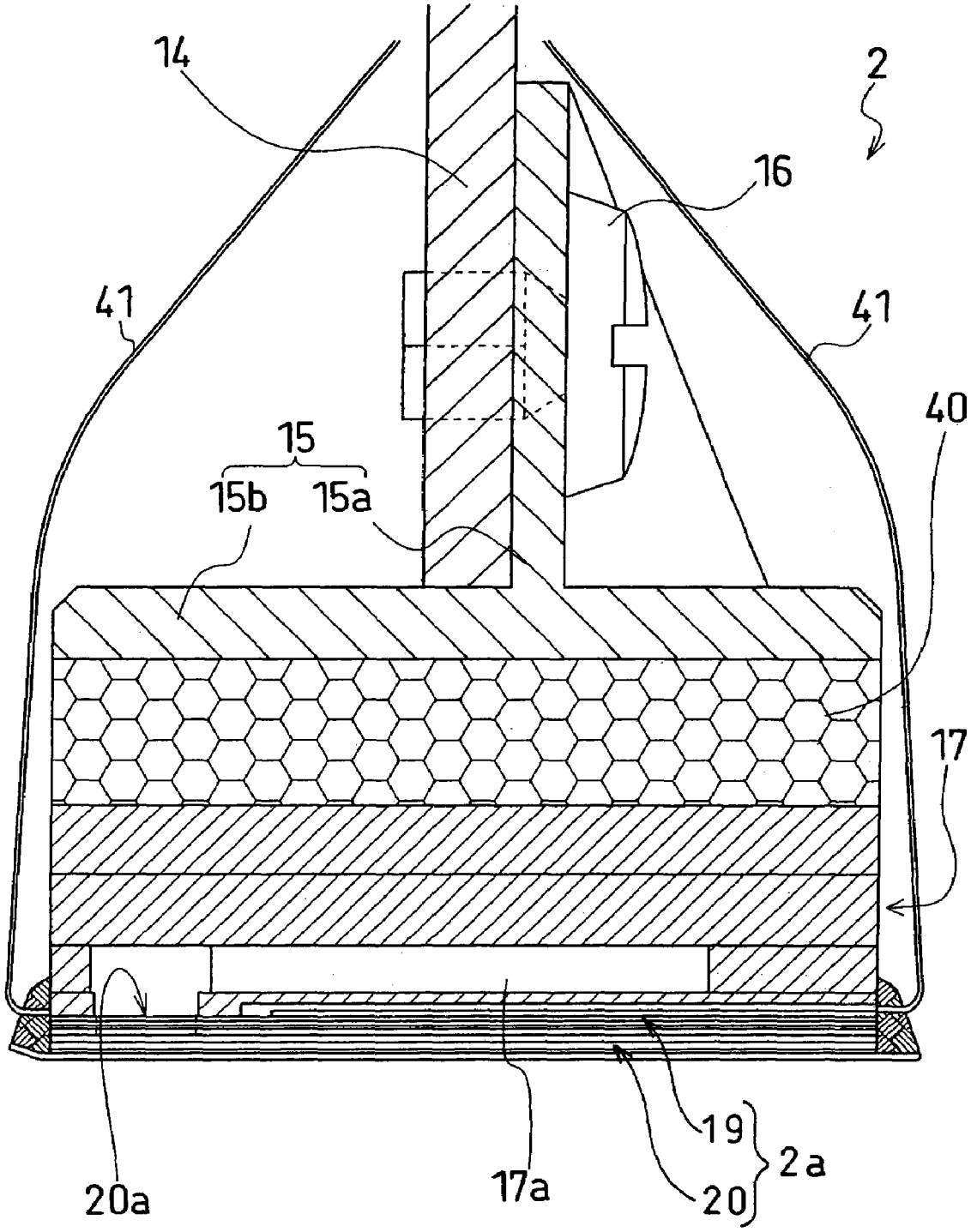
FIG. 3 is a partial sectional view of an inkjet head in FIG. 1.

FIG. 3 illustrates a partial sectional view of an inkjet head 2. The inkjet head 2 is attached through a holder 15 to an adequate member 14 provided within the printer 1. The holder 15 has an inversed-T shape in a side view, made up of a vertical portion 15*a* and a horizontal portion 15*b*. The vertical portion 15*a* is fixed to the member 14 with a screw 16. A base block 17 and a head main body 2*a* are fixed in this order to the lower face of the horizontal portion 15*b* with a spacer member 40 being interposed therebetween.

An ink reservoir 17*a* is formed within the base block 17 along the length of the base block 17, i.e., perpendicularly to FIG. 3. The ink reservoir 17*a* is always filled up with ink supplied from a non-illustrated ink tank through an adequate pipe.

The head main body 2*a* includes an ink passage unit 20 and an actuator unit 19. As will be described later, ink passages each including a pressure chamber are formed in the ink passage unit 20. The actuator unit 19 applies pressure to ink in the pressure chamber. The ink passage unit 20 has an inlet port 20*a* (see FIG. 2 or 3) facing the base block 17. The ink passage unit 20 is bonded to the base block 17 so that the inlet port 20*a* is connected to the ink reservoir 17*a* in the base block 17. Thus, ink in the ink reservoir 17*a* can flow into the ink passage unit 20 through the inlet port 20*a*.

The actuator unit 19 is bonded to the upper face of the ink passage unit 20, more specifically, in a region other than the region where the upper face of the ink passage unit 20 is bonded to the base block 17. The actuator unit 19 is separated from the base block 17. That is, although the base block 17 is bonded to the ink passage unit 20 in the vicinity of the inlet port 20*a*, the base block 17 is separated from the head main body 2*a* in the other region. The actuator unit 19 is disposed within the separation region. As illustrated with broken lines in FIG. 2, each actuator unit 19 has a trapezoidal shape in plane. Actuator units 19 are arranged in two rows in a zigzag manner along the length of each head 2. Each actuator unit 19 is disposed so that its parallel opposite sides, i.e., the upper and lower sides, are along the length of the ink passage unit 20. Oblique sides of neighboring actuator units 19 overlap each other along the width of the ink passage unit 20. The region of the lower face of the ink passage unit 20 corresponding to the region where each actuator unit 19 is bonded, is an ink ejection region.

Pairs of inlet ports 20*a* of each ink passage unit 20 as described above are arranged in two rows in a zigzag manner so as to correspond to regions where no actuator unit 19 is disposed. Because the plural inlet ports 20*a* are thus arranged at intervals along the length of each ink passage unit 20, even in case of a long head 2, ink in each ink reservoir 17*a* can be stably supplied to the ink passage unit 20 with suppressing the flow resistance.

Figure 4:
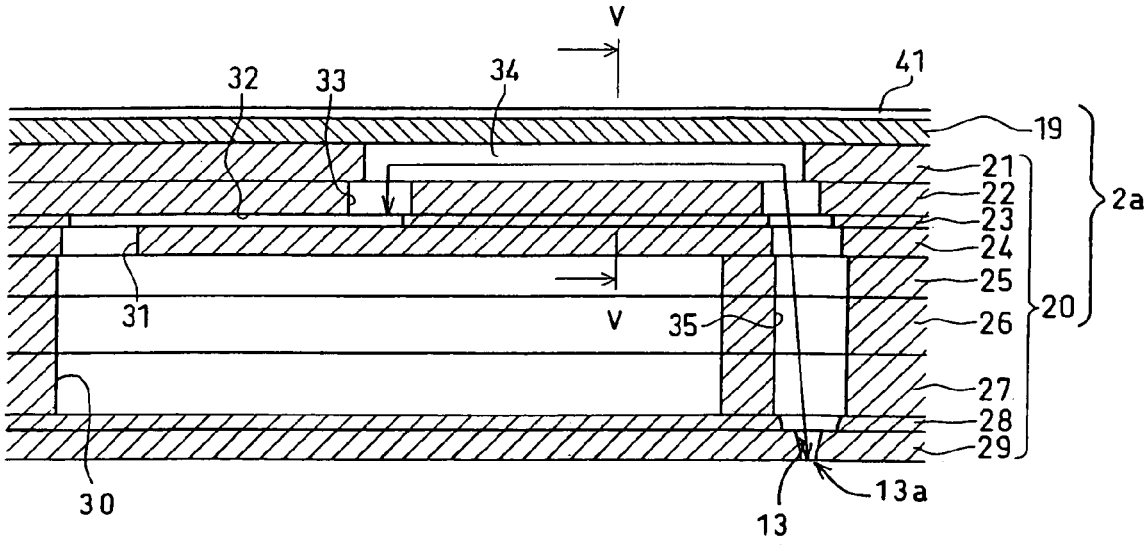
FIG. 4 is an enlarged sectional view illustrating an ink passage in an ink passage unit in a head main body of an inkjet head in FIG. 1.

Next, an ink passage in the ink passage unit 20 will be described in more detail with reference to FIG. 4. FIG. 4 is an enlarged sectional view illustrating an ink passage in the ink passage unit 20 in a head main body 2*a* in FIG. 1.

Referring to FIG. 4, the ink passage unit 20 has a structure wherein nine thin metallic plates 21, 22, 23, 24, 25, 26, 27, 28, and 29 are put in layers. A manifold channel 30 is formed over the fifth to seventh plates 25 to 27 from the upper side.

The manifold channel 30 is connected to an inlet port 20*a* as described above, through a non-illustrated passage. A connection hole 31 is formed in the fourth plate 24 immediately above the fifth plate 25. The connection hole 31 is connected to an aperture 32 formed in the third plate 23.

The aperture 32 is connected through a connection hole 33 formed in the second plate 22, to one end of a pressure chamber 34 formed in the first plate 21. The pressure chamber 34 is for applying pressure to ink by means of deformation of the actuator unit 19 fixed to the upper face of the ink passage unit 20. One pressure chamber 34 is provided to correspond to each nozzle 13. The other end of the pressure chamber 34 is connected through a nozzle connection hole 35 formed through the second to eight plates, to a tapered nozzle 13 formed in the ninth plate 29, i.e., nozzle plate. An ink ejection port 13*a* is formed at the tip end of the nozzle 13.

Thus, within the ink passage unit 20, formed are ink passages each individually corresponding to each nozzle 13 and extending from the manifold channel 30 to the aperture 32, the pressure chamber 34, the nozzle connection hole 35, and the nozzle 13.

Each pressure chamber 34 has a planer shape of elongated rhomboid or parallelogram with their corners rounded, though the illustration is omitted.

Figure 5:
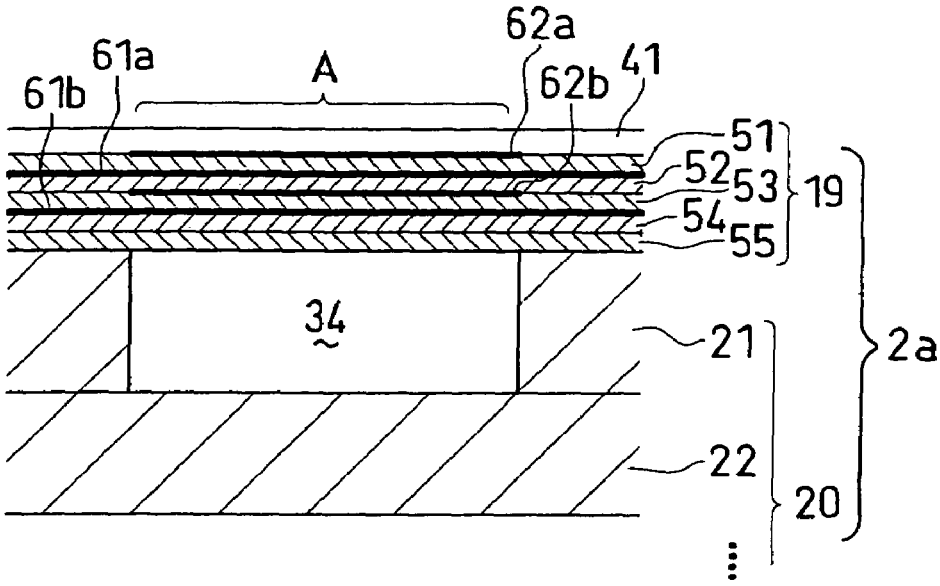
FIG. 5 is a sectional view taken along line V—V in FIG. 4, illustrating a specific structure of an actuator unit.

Next, the actuator unit 19 will be described in more detail with reference to FIG. 5. FIG. 5 is a sectional view taken along line V—V in FIG. 4.

Referring to FIG. 5, the actuator unit 19 includes five piezoelectric sheets 51, 52, 53, 54, and 55 having the same thickness of about 15 micrometer. The piezoelectric sheets 51 to 55 are made into a continuous layered plate (continuous plate layer) disposed over many pressure chambers 34 formed within one ink ejection region in the inkjet head 2. Because the piezoelectric sheets 51 to 55 are disposed as a continuous plate layer over many pressure chambers 34, the mechanical rigidity of the piezoelectric element can be kept high and the responsibility of ink ejection of the inkjet head 2 can be improved.

An about 2 micrometer-thick common electrode 61*a* is interposed between the first and second piezoelectric sheets 51 and 52 from the upper side. Also, an about 2 micrometer-thick common electrode 61*b* is interposed between the third and fourth piezoelectric sheets 53 and 54. Either of the common electrodes 61*a* and 61*b* is one conductive sheet extending substantially over the whole area of one actuator unit 19. The common electrodes 61*a* and 61*b* are grounded in a non-illustrated region so that the area of either of the common electrodes 61*a* and 61*b* corresponding to all pressure chambers 34 is kept at the ground potential.

An about 1 micrometer-thick individual electrode 62*a* is provided on the upper face of the first piezoelectric sheet 51 to correspond to each pressure chamber 34. An about 2 micrometer-thick individual electrode 62*b* made like the individual electrode 62*a* is interposed between the second and third piezoelectric sheets 52 and 53. The region where the individual electrodes 62*a* and 62*b* are disposed works as a pressure generation portion A for applying pressure to ink in the pressure chamber 34.

No electrode is provided between the fourth and fifth piezoelectric sheets 54 and 55 and on the lower face of the fifth piezoelectric sheet 55.

Each of the electrodes 61*a*, 61*b*, 62*a*, and 62*b* is made of an Ag—Pd-base metallic material for example.

As illustrated in FIGS. 4 and 5, a flexible printed circuit (FPC) 41 as a power supply member is bonded to the upper face of the actuator unit 19. As illustrated in FIG. 3, the FPC 41 extends out from sides of the inkjet head main body 2*a* and the extensions are bent upward to be connected to a driver IC 80 (see FIG. 1) disposed on a side face of the member 14. The driver IC 80 is connected to a circuit board 81. Each pair of individual electrodes 62*a* and 62*b* are electrically connected through a lead provided within the FPC 41 independently for each pair of individual electrodes 62*a* and 62*b*, to the driver IC 80 and further to an MCU (Micro Controller Unit) 82 mounted on the circuit board 81 (see FIG. 1). Thus, each pressure chamber 34 can be controlled in electric potential independently of another pressure chamber 34.

In the inkjet head 1 of this embodiment, the first to third piezoelectric sheets 51 to 53 have been polarized along the thickness of each sheet. Therefore, when a pair of individual electrodes 62*a* and 62*b* are set at a potential different from that of the common electrodes 61*a* and 61*b* to apply an electric field to the piezoelectric sheets 51 to 53 along the polarization, the portion of each of the piezoelectric sheets 51 to 53 to which the electric field is applied works as an active portion that distorts by a piezoelectric effect. The active portion is going to extend or contract in the thickness of the sheet and to contract or extend in the plane of the sheet perpendicular to the thickness of the sheet by the transverse piezoelectric effect. On the other hand, because the remaining two piezoelectric sheets 54 and 55 are inactive layers having no regions sandwiched by the individual electrodes 62*a* and 62*b* and the common electrodes 61*a* and 61*b*, they can not be deformed by themselves. That is, the actuator unit 19 has a unimorph type structure in which the upper three piezoelectric sheets 51 to 53 distant from each pressure chamber 34 are layers including active portions and the lower two piezoelectric sheets 54 and 55 near each pressure chamber 34 are inactive layers.

In this structure, when the driver IC 80 is controlled to set a pair of individual electrodes 62*a* and 62*b* at a predetermined positive or negative potential relative to that of the common electrodes 61*a* and 61*b* so that an electric field is applied in the same direction as the polarization, the portions, i.e., active portions, of the piezoelectric sheets 51 to 53 sandwiched by the electrodes contract in the plane of each sheet. On the other hand, because the piezoelectric sheets 54 and 55 as inactive layers are not influenced by the electric field, they do not contract by themselves and are adapted to restrict deformations of the active portions, As a result, a difference in strain along the polarization is generated between the upper piezoelectric sheets 51 to 53 and the lower piezoelectric sheets 54 and 55, and thereby the piezoelectric sheets 51 to 55 are deformed into a convex shape toward the corresponding pressure chamber 34, which is called unimorph deformation.

Figure 6:
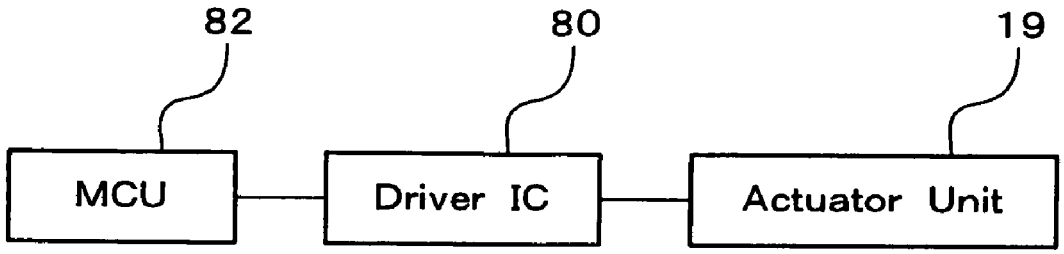
FIG. 6 is a block diagram of a general electrical construction of the inkjet printer of FIG. 1.

Control of the actuator unit 19 will be now described with reference to FIG. 6. The MCU 82 shown in FIG. 6 is a controller disposed on the circuit board 81 of FIG. 2, for general control of the inkjet printer 1. The MCU 82 includes therein an MPU (Micro Processor Unit), a ROM, and a RAM, any of which is not illustrated. The ROM stores therein kinds of pulse waveform data corresponding to different total volumes of ink droplets to be ejected in accordance with image gradation. The RAM can store therein image data to be printed, as occasion demands. The MPU generates serial print data based on the image data stored in the RAM, and outputs the serial print data together with the kinds of pulse waveform data stored in the ROM, to the driver IC 80.

The driver IC 80 includes therein a shift register, a multiplexer, and a drive buffer, any of which is not illustrated. The shift register converts the serial print data received from the MCU 82, into parallel data to support individual data for each nozzle 13 of the head 2. The multiplexer selects adequate one out of the kinds of pulse waveform data for ink ejection, on the basis of the data received from the shift register, and outputs the selected data to the drive buffer. The drive buffer generates a voltage pulse having a predetermined level, on the basis of the data received from the multiplexer, and supplies the voltage pulse through the FPC 41 (see FIG. 3) to the individual electrodes 62*a* and 62*b* of the actuator unit 19 corresponding to each nozzle 13. Thereby, the actuator unit 19 corresponding to each nozzle 13 is driven to form a desired image on a print paper.

Figure 7A:
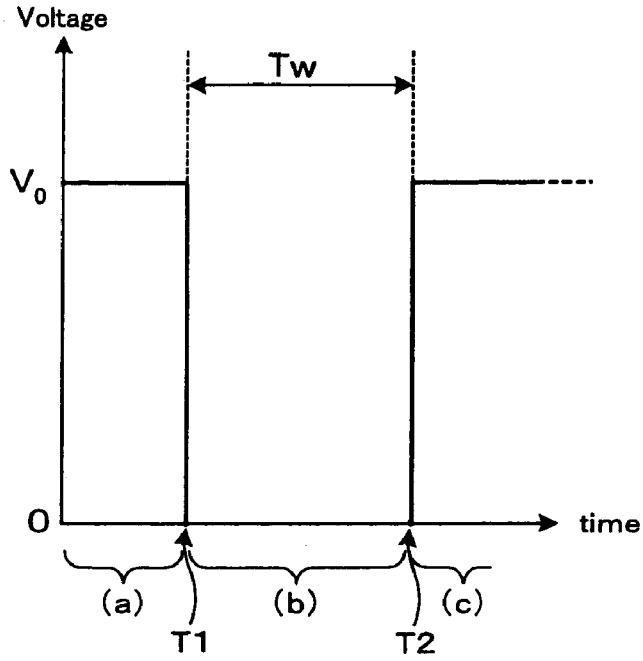
FIG. 7A is a graph roughly showing the waveform of a voltage pulse supplied from a driver IC to the actuator unit.
Figure 7B:
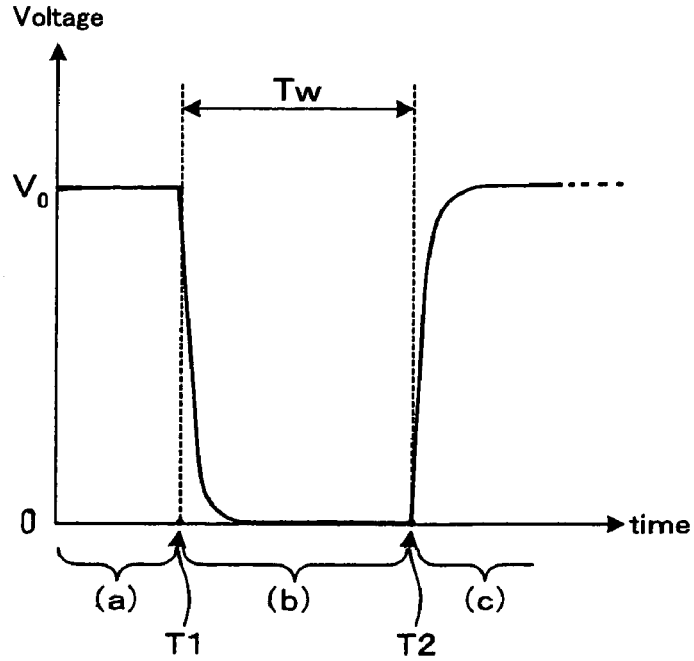
FIG. 7B is a graph, corresponding to FIG. 7A, showing a change in voltage of an individual electrode in the actuator unit having received the voltage pulse of FIG. 7A.

Next, the waveform of the voltage pulse generated by the driver IC 80 to be applied to individual electrodes 62*a* and 62*b* of the actuator unit 19 and a change in voltage of the individual electrodes 62*a* and 62*b* having received the voltage pulse will be described with reference to FIGS. 7A and 7B. FIG. 7A is a graph roughly showing the waveform of the voltage pulse supplied from the driver IC 80 to the actuator unit 19. FIG. 7B is a graph, corresponding to FIG. 7A, showing a change in voltage of the individual electrodes 62*a* and 62*b* in the actuator unit 19 having received the voltage pulse of FIG. 7A.

In the waveform of the voltage pulse of FIG. 7A, the voltage is V0 in the ranges (a) and (c) and the voltage is zero in the range (b). The time Tw of the range (b) is "the pulse width of the voltage pulse" according to the invention. The individual electrodes 62*a* and 62*b* of the actuator unit 19 having received such a voltage pulse form a capacitor. The individual electrodes 62*a*, 62*b* and the common electrode 61*a*, 61*b* sandwich the piezoelectric sheets 51, 52 and 53 as a dielectric as shown in FIG. 5. The individual electrodes 62*a*, 62*b* exhibit a change in voltage as shown in FIG. 7B with a delay corresponding to a charge time of the capacitor. The time points T1 and T2 and the time Tw of FIG. 7A correspond to the time points T1 and T2 and the time Tw of FIG. 7B, respectively.

Figure 8A:
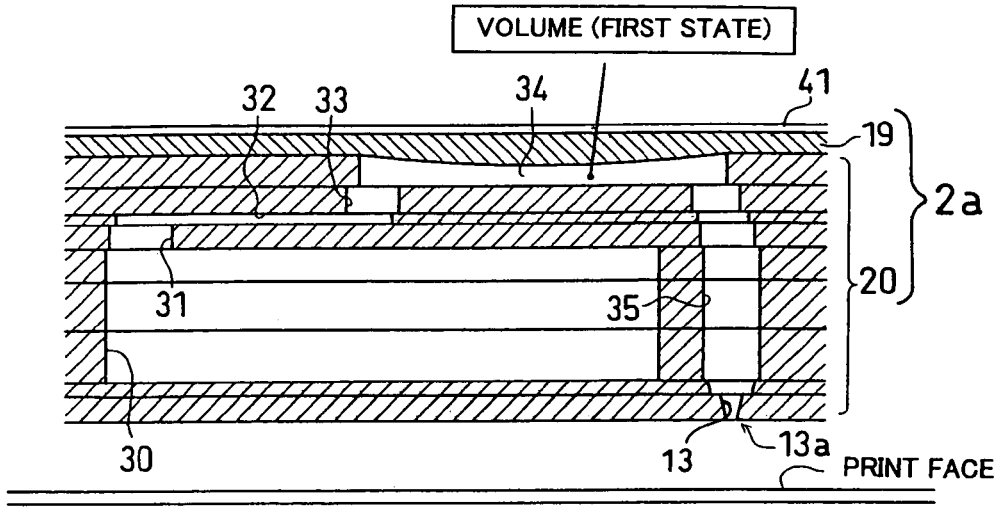
FIGS. 8A to 8C illustrate states of ejecting ink through a nozzle by the drive of an actuator unit, in the order of time elapsing.
Figure 8B:
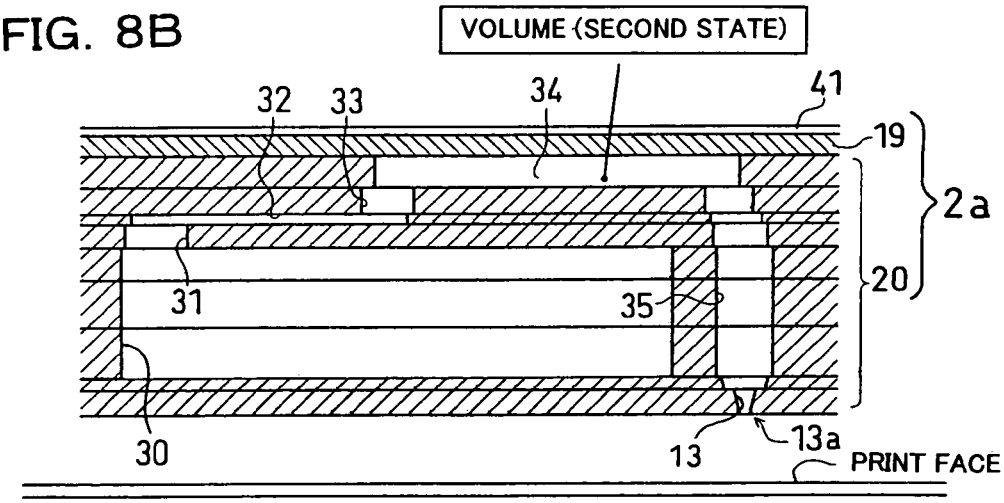
Figure 8C:
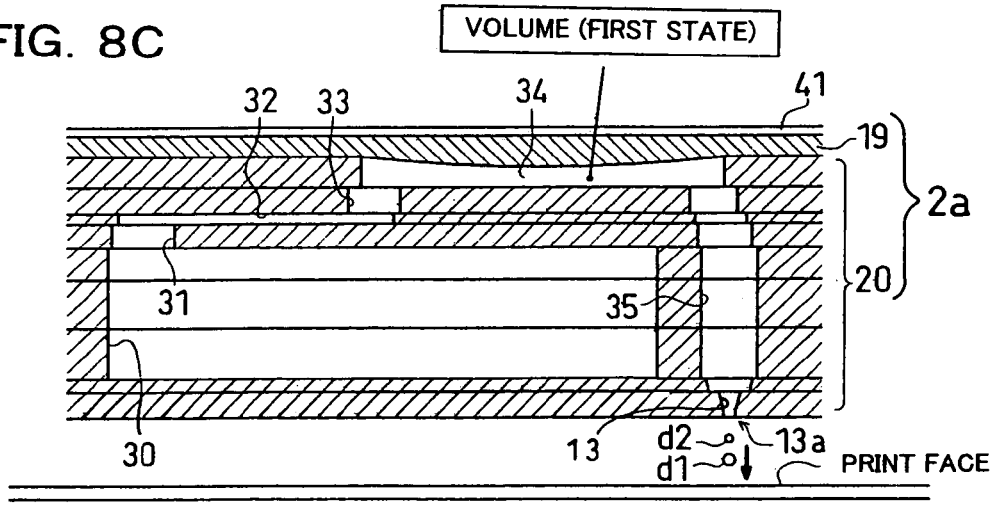

Further, drive of the actuator unit 19 having received the voltage pulse of FIG. 7A will be described with reference to FIGS. 8A to 8C. FIGS. 8A to 8C illustrate states of ejecting ink through a nozzle 13 by the drive of the actuator unit 19, in the order of time elapsing.

FIG. 8A corresponds to (a) of FIG. 7B wherein a predetermined voltage V0 is applied to individual electrodes 62*a* and 62*b*. In this state, the lower face of the actuator unit 19 in the region of the pressure generation portion A of FIG. 5 is deformed into a convex shape toward the corresponding pressure chamber 34. In this state, the volume of the pressure chamber 34 is V1. This state will be referred to as first state of the actuator unit 19.

FIG. 8B corresponds to (b) of FIG. 7B wherein the voltage of the individual electrodes 62*a* and 62*b* is zero. In this state, the convex deformation of the actuator unit 19 as illustrated in FIG. 8A has disappeared. The volume V2 of the pressure chamber 34 at this time increases as compared with the volume V1 of the pressure chamber 34 as shown in FIG. 8A. This state will be referred to as second state of the actuator unit 19. As a result of such an increase in volume of the pressure chamber 34, ink is sucked from the corresponding manifold channel 30 into the pressure chamber 34.

FIG. 8C corresponds to (c) of FIG. 7B wherein the individual electrodes 62*a* and 62*b* are again set at the voltage V0 . In this state, the lower face of the actuator unit 19 is deformed into a convex shape toward the pressure chamber 34 like FIG. 8A. That is, at this time, the actuator unit 19 is in the first state. As a result, pressure is applied to ink in the pressure chamber 34 and thereby two separate large and small ink droplets d1 and d2 are ejected through the ink ejection port 13*a* at the tip of the corresponding nozzle 13. The ink droplets d1 and d2 will reach the print face of a print paper to form dots.

As described above, in the drive of the actuator unit 19 of this embodiment, the volume of the pressure chamber 34 is once increased (FIGS. 8A to 8B) to generate a negative pressure wave, and then the volume of the pressure chamber 34 is again decreased (FIG. 8B to 8C) at the timing when this pressure wave returns as a positive pressure wave traveling toward the nozzle 13 side after being reflected by the end parts of the ink passage within the ink passage unit 20. This is a technique so-called "fill before fire". By this technique, the positive pressure wave having reflected as described above can be superimposed on the positive pressure wave generated by the deformation of the actuator unit 19, to apply intense pressure to ink. Accordingly, the size of the pressure chamber 34 can be decreased or the drive voltage for the actuator unit 19 can be lowered. This technique is advantageous in the points of a highly dense arrangement of pressure chambers 34, a decrease in size of the inkjet head 2, and the running cost upon driving the inkjet head 2.

In case of adopting "fill before fire" having the above-described advantages in particular, two separate ink droplets can be ejected by one ink ejection action because of the relation between vibration of ink meniscus formed in the ink ejection port 13*a* and the timing when the pressure chamber reaches the ink meniscus portion.

In this embodiment, as shown in FIG. 7A, the width Tw of the voltage pulse to be applied to the actuator unit 19 is controlled to be shorter than the pulse width Tmax at which the maximum ejection speed of ink ejected from the nozzle 13 is obtained. This pulse width Tmax, in this embodiment, corresponds to a time period in which the pressure wave propagates from the ink ejection port 13*a* connected to one end of the pressure chamber 34, to the outlet of the aperture 32 near the pressure chamber 34 side, connected to the other end of the pressure chamber 34 (the part indicated by an arrow within the passage in FIG. 4). The width Tw is preferably controlled to be not less than 0.7 Tmax and not more than 0.8 Tmax. In other words, as apparent from FIG. 7B, the time period Tw from the time point T1 when the actuator unit 19 starts to change from the first state to the second state, until the time point T2 when the actuator unit 19 starts to change from the second state to the first state, is controlled to be shorter than Tmax, preferably, not less than 0.7 Tmax and not more than 0.8 Tmax.

Thereby, with a simple waveform (see FIG. 7A) of the voltage pulse for driving the actuator unit 19 in comparison with a case of applying two pulses, two of large and small ink droplets such as d1 and d2 of FIG. 8C can be successively ejected in the order of the large and small ink droplets. Therefore, the room can be increased for improving the print quality by, e.g., canceling the pressure wave remaining within the ink passage.

The above-described knowledge has been obtained from results of an experiment made by the present inventor. The experiment will be described below in detail.

In the experiment, three kinds of inkjet head main bodies 2*a* were prepared in which each pressure chamber 34 is varied in shape, as Tmax=5.4 microseconds, Tmax=5.2 microseconds, and Tmax=5.0 microseconds. Voltage pulses as shown in FIG. 7A having different pulse widths Tw were applied to each head main body 2*a*. Under these conditions, the ejection speeds of two ink droplets d1 and d2 ejected through an ink ejection port 13*a* were measured and each ejected ink droplet was photographed and image-processed to measure the sizes of ink droplets d1 and d2.

Figure 10:
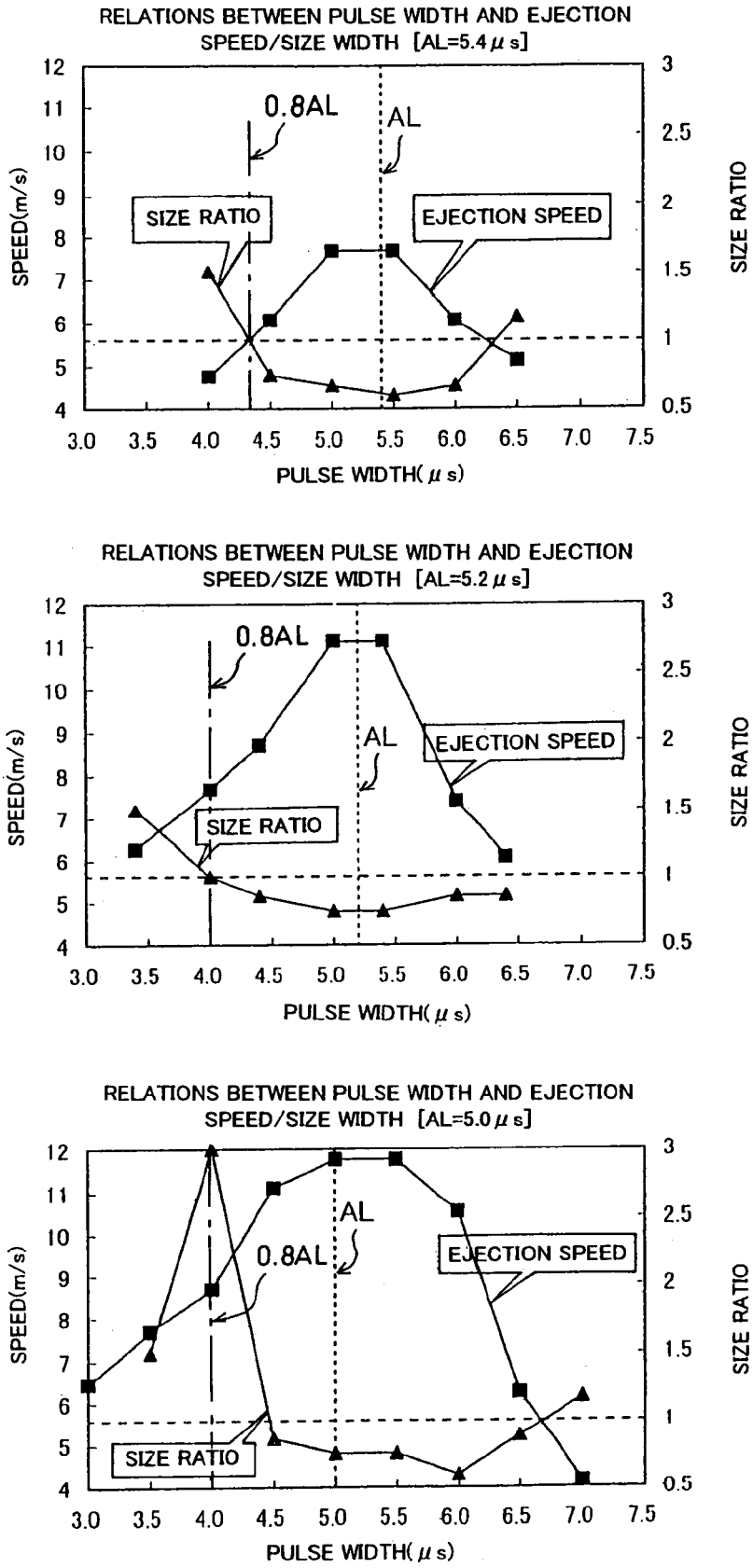
FIG. 10 are graphs showing the results of FIG. 9.

FIG. 9 are tables showing results of measurements of ejection speeds and size ratios of ink droplets when the pulse width Tw of the voltage pulse of FIG. 7A is variously changed, in the respective cases of Tmax=5.4 microseconds, Tmax=5.2 microseconds, and Tmax=5.0 microseconds. FIG. 10 are graphs showing the results of FIG. 9. In the experiment, an ink droplet d1 first ejected through an ink ejection port 13*a* is supposed to be a first ink droplet, and an ink droplet d2 successively ejected through the ink ejection port 13 is supposed to be a second ink droplet. The size ratio means the ratio of their sizes (the diameter of the first ink droplet d1)/(the diameter of the second ink droplet d2). Therefore, when the size ratio is larger than one, the first ink droplet d1 is larger than the following second ink droplet d2. In each of FIG. 10, the axis of abscissas represents pulse width Tw, the left axis of ordinates does ink droplet ejection speed, and the right axis of ordinates does ink droplet size ratio.

The ejection speed of the ink droplet becomes higher as the pressure wave synthesized during the above-described "fill-before-fire" gets larger.

As seen from FIGS. 9 and 10, when the pulse width Tw of the voltage pulse is increased, the ejection speed of the ink droplet gradually becomes higher, and then drops after reaching a peak value.

As shown in the uppermost graph of FIG. 10, when Tmax=5.4 microseconds, the ink droplet size ratio exceeded one in the range wherein the pulse width Tw was not more than 4.3 microseconds, which was nearly equal to 0.8 Tmax. The ink droplet size ratio of more than one means that the first ink droplet d1 first ejected is larger in volume than the following second ink droplet d2. Because the small second ink droplet d2 is higher in speed than the large first ink droplet d1, this reduces the difference between the timing when the first ink droplet d1 reaches the print face and the timing when the second droplet d2 reaches the print face. Also, as shown in the middle graph of FIG. 10, when Tmax=5.2 microseconds, the ink droplet size ratio exceeded one in the range wherein the pulse width Tw was not more than 4.0 microseconds, which was nearly equal to 0.8 Tmax. As shown in the lowermost graph of FIG. 10, when Tmax=5.0 microseconds, the ink droplet size ratio exceeded one in the range wherein the pulse width microseconds, which was nearly equal to 0.8 Tmax.

In the range wherein Tw is not more than 0.8 Tmax, any of the three graphs of FIG. 10 shows a tendency that the ink droplet ejection speed reduces, i.e., the pressure applied to ink reduces, as the pulse width Tw decreases. In consideration of a request that the size of each pressure chamber 34 is decreased for a highly dense arrangement in order to realize a high-resolution ink-jet head, and a request that the consumption power of the actuator unit 19 is held down, the higher ink droplet ejection speed is superior under the same conditions. Considering these in total, Tw in the range of not more than 0.7 Tmax and not less than 0.8 Tmax is most preferable on the points of improvement of print quality, a highly dense arrangement of pressure chambers 34, a decrease in size of the inkjet head 2, and reduction of the consumption power of the actuator unit 19.

When pressure chambers 34 are densely arranged, controlling each pressure chamber 34, that is, controlling the actuator unit 19 corresponding to each pressure chamber 34 may be complicated. However, by adopting the method of this embodiment, the actuator unit 19 can efficiently be controlled with realizing a highly dense arrangement of the pressure chambers 34.

On the other hand, when the pulse width Tw is not less than Tmax, because the pulse period is longer than that in case of Tw of less than Tmax, a printing operation must take a long time and this is inefficient. In addition, as clearly shown in the lowermost graph of FIG. 10, the fall of the ink droplet ejection speed is relatively rapid. For these reasons, it is preferable that the pulse width Tw is shorter than Tmax.

In this embodiment, the actuator unit 19 is driven with such a voltage pulse as shown in FIG. 7A applied from the driver IC 80. Upon ink ejection, the actuator unit 19 can be controlled accurately and surely in the manner that the actuator unit 19 is set to the first, second, and first states as in FIG. 8A to EC in this order, and, as shown in FIG. 7B, the time period Tw from the timing T1 when the actuator unit 19 starts to change from the first state to the second state until the timing T2 when the actuator unit 19 starts to change from the second state to the first state is made equivalent to the pulse width Tw of the voltage pulse.

In addition to such a line-printing type inkjet printer as in the above embodiment in which printing is performed with moving a print paper relatively to the fixed head main body 2*a*, the present invention is applicable to, e.g., a serial-printing type inkjet printer in which printing is performed with moving a print paper and reciprocating a head main body 18 perpendicularly to the movement of the print paper.

Further, the present invention is not limited to inkjet printers but applicable also to, e.g., inkjet type facsimiles and copying machines.

Figure 11:
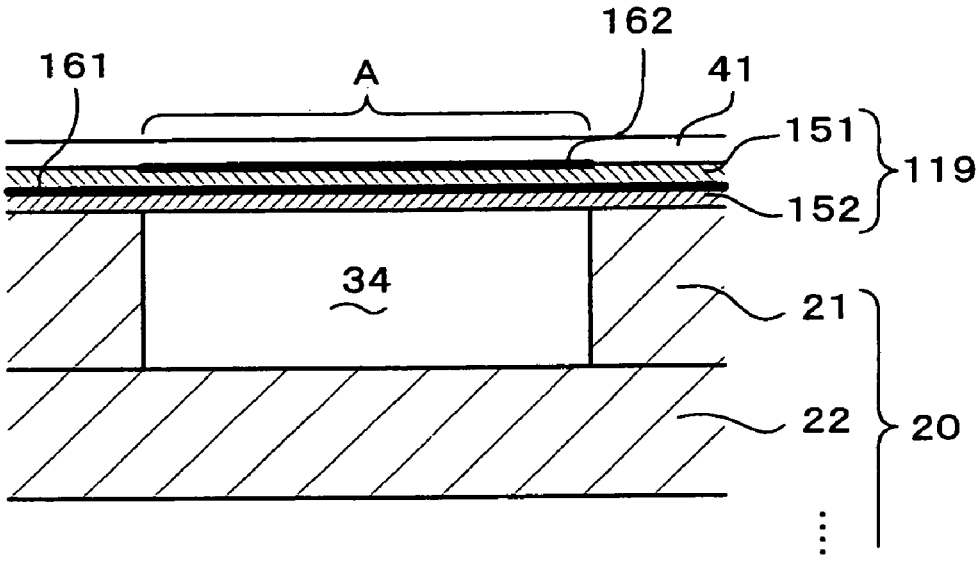
FIG. 11 is a sectional view of an modification of the actuator unit, corresponding to FIG. 5.

Further, the structure of the head including the actuator unit 19, pressure chambers 34, etc., is not limited to that of the above embodiment. For example, the actuator unit can have a structure as illustrated in FIG. 11. This actuator unit 119 includes two piezoelectric sheets 151 and 152. A common electrode 161 is interposed between the piezoelectric sheets 151 and 152. Individual electrodes 162 are provided on the face of the upper piezoelectric sheet 151 near the FPC 41 so as to correspond to the respective pressure chambers 34. Even in case of an actuator unit thus different in structure from the above-described embodiment, effective control can be made by applying the present invention. Further, each pressure chamber 34 is not limited to a rhombic or parallelogrammic shape. For example, each pressure chamber 34 may have a rectangular shape. In short, each pressure chamber 34 may have a longitudinal axis along an adequate direction and have its one end connected to a nozzle 13.

Figure 12:
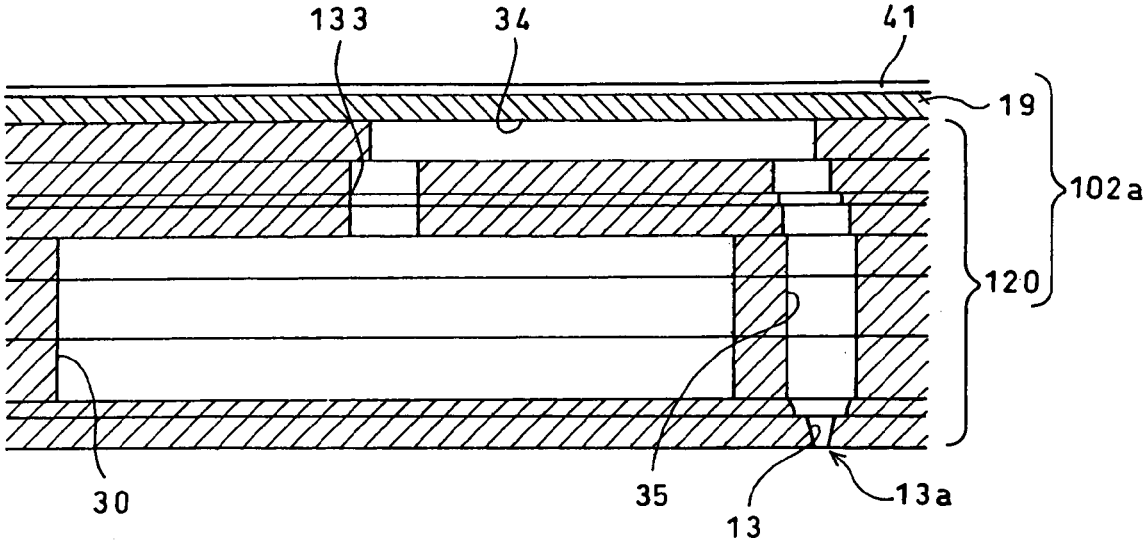
FIG. 12 is a sectional view of an modification of the ink passage unit, corresponding to FIG. 4.

In the above embodiment, "a time period in which the pressure wave propagates from the ink ejection port 13*a* to the outlet of the aperture 32 near the pressure chamber 34 side in the ink passage within the ink passage unit 120" corresponds to the pulse width Tmax at which the maximum ejection speed of ink is obtained. However, this is not limitative. As shown in FIG. 12, for example, when the head main body 102*a* does not comprise the aperture 32 (see FIG. 4) and a cylindrical connection hole 133 is formed extending from the pressure chamber 34 to the manifold channel 30, "a time period in which the pressure wave propagates from the ink ejection port 13*a* to the outlet of the manifold channel 30 near the pressure chamber 34 side in the ink passage within the ink passage unit 120" may be considered to correspond to 'Tmax' in the present invention. That is, a value of the pulse width 'Tmax' at which the maximum ink ejection speed is obtained varies in accordance with configurations of the ink passage within the ink passage unit 120.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An inkjet printing apparatus comprising:

a plurality of pressure chambers each having one end connected to a nozzle;

an actuator that can take two states of a first state wherein the volume of a pressure chamber is V1, and a second state wherein the volume of the pressure chamber is V2 larger than V1; and an actuator controller for supplying a voltage pulse to the actuator to change a state of the actuator from the first state to the second state and then to the first state again so that two separate ink droplets consisting of a main droplet and a satellite droplet smaller than the main droplet are successively ejected through the nozzle, a pulse width Tw of the voltage pulse during the second state being shorter than a pulse width Tmax at which a maximum ejection speed of ink ejected from the nozzle is obtained, wherein the two separate ink droplets are ejected whenever the state of the actuator is changed from the second state to the first state.

2. The inkjet printing apparatus according to claim 1, wherein the pulse width Tw of the voltage pulse is not less than 0.7 Tmax and not more than 0.8 Tmax.

3. An inkjet printing apparatus comprising:

a plurality of pressure chambers each having one end connected to a nozzle;

an actuator that can take two states of a first state wherein the volume of a pressure chamber is V1, and a second state wherein the volume of the pressure chamber is V2 larger than V1; and an actuator controller for changing a state of the actuator from the first state to the second state and then to the first state again so that two separate ink droplets consisting of a main droplet and a satellite droplet smaller than the main droplet are successively ejected through the nozzle, the actuator controller controlling a time period Tw during the second state from a timing T1 when the actuator starts to change from the first state to the second state, until a timing T2 when the actuator starts to change from the second state to the first state, to be shorter than a pulse width Tmax at which a maximum ejection speed of ink ejected from the nozzle is obtained, wherein the two separate ink droplets are ejected whenever the state of the actuator is changed from the second state to the first state.

4. The inkjet printing apparatus according to claim 3, wherein the time period Tw from the timing T1 when the actuator starts to change from the first state to the second state until the timing T2 when the actuator starts to change from the second state to the first state is not less than 0.7 Tmax and not more than 0.8 Tmax.

5. The inkjet printing apparatus according to claim 3, wherein the actuator controller supplies a voltage pulse to the actuator to change a state of the actuator from the first state to the second state and then to the first state again so that ink is ejected through the nozzle.

6. An actuator controller for controlling the drive of an actuator included in an inkjet printing apparatus, the inkjet printing apparatus comprising a plurality of pressure chambers each having one end connected to a nozzle, the actuator being able to take two states of a first state wherein the volume of a pressure chamber is V1, and a second state wherein the volume of the pressure chamber is V2 larger than V1, the actuator controller supplying a voltage pulse to the actuator to change a state of the actuator from the first state to the second state and then to the first state again so that two separate ink droplets consisting of a main droplet and a satellite droplet smaller than the main droplet are successively ejected through the nozzle, a pulse width Tw of the voltage pulse during the second state being shorter than a pulse width Tmax at which a maximum ejection speed of ink ejected from the nozzle is obtained, wherein the two separate ink droplets are ejected whenever the state of the actuator is changed from the second state to the first state.

7. The actuator controller according to claim 6, wherein the pulse width Tw of the voltage pulse is not less than 0.7 Tmax and not more than 0.8 Tmax.

8. An actuator controller for controlling the drive of an actuator included in an inkjet printing apparatus, the inkjet printing apparatus comprising a plurality of pressure chambers each having one end connected to a nozzle, the actuator being able to take two states of a first state wherein the volume of a pressure chamber is V1, and a second state wherein the volume of the pressure chamber is V2 larger than V1, the actuator controller changing a state of the actuator from the first state to the second state and then to the first state again so that two separate ink droplets consisting of a main droplet and a satellite droplet smaller than the main droplet are successively ejected through the nozzle, the actuator controller controlling a time period Tw during the second state from a timing T1 when the actuator starts to change from the first state to the second state, until a timing T2 when the actuator starts to change from the second state to the first state, to be shorter than a pulse width Tmax at which a maximum ejection speed of ink ejected from the nozzle is obtained, wherein the two separate ink droplets are ejected whenever the state of the actuator is changed from the second state to the first state.

9. The actuator controller according to claim 8, wherein the time period Tw from the timing T1 when the actuator starts to change from the first state to the second state until the timing T2 when the actuator starts to change from the second state to the first state is not less than 0.7 Tmax and not more than 0.8 Tmax.

10. The actuator controller according to claim 8, the actuator controller supplies a voltage pulse to the actuator to change a state of the actuator from the first state to the second state and then to the first state again so that ink is ejected through the nozzle.

11. A method of controlling the drive of an actuator included in an inkjet printing apparatus, the inkjet printing apparatus comprising a plurality of pressure chambers each having one end connected to a nozzle, the actuator being able to take two states of a first state wherein the volume of a pressure chamber is V1, and a second state wherein the volume of the pressure chamber is V2 larger than V1, a state of the actuator changing from the first state to the second state and then to the first state again so that two separate ink droplets consisting of a main droplet and a satellite droplet smaller than the main droplet are successively ejected through the nozzle, the method comprising a step of supplying a voltage pulse to the actuator, the voltage pulse having a pulse width Tw during the second state shorter than a pulse width Tmax at which a maximum ejection speed of ink ejected from the nozzle is obtained, wherein the two separate ink droplets are ejected whenever the state of the actuator is changed from the second state to the first state.

12. The method according to claim 11, wherein the pulse width Tw of the voltage pulse is not less than 0.7 Tmax and not more than 0.8 Tmax.

13. A method of controlling the drive of an actuator included in an inkjet printing apparatus, the inkjet printing apparatus comprising a plurality of pressure chambers each having one end connected to a nozzle, the actuator being able to take two states of a first state wherein the volume of a pressure chamber is V1, and a second state wherein the volume of the pressure chamber is V2 larger than V1, a state of the actuator changing from the first state to the second state and then to the first state again so that two separate ink droplets consisting of a main droplet and a satellite droplet smaller than the main droplet are successively ejected through the nozzle, the method comprising a step of controlling a time period Tw during the second state from a timing T1 when the actuator starts to change from the first state to the second state, until a timing T2 when the actuator starts to change from the second state to the first state, to be shorter than a pulse width Tmax at which a maximum ejection speed of ink ejected from the nozzle is obtained, wherein the two separate ink droplets are ejected whenever the state of the actuator is changed from the second state to the first state.

14. The method according to claim 13, wherein the time period Tw from the timing T1 when the actuator starts to change from the first state to the second state until the timing T2 when the actuator starts to change from the second state to the first state is not less than 0.7 Tmax and not more than 0.8 Tmax.

15. The method according to claim 13, wherein a voltage pulse is supplied to the actuator to change a state of the actuator from the first state to the second state and then to the first state again so that ink is ejected through the nozzle.

* * * * *